US006425787B1

(12) United States Patent
Hersom

(10) Patent No.: US 6,425,787 B1
(45) Date of Patent: Jul. 30, 2002

(54) OUTBOARD REFLECTOR KIT

(76) Inventor: Brian R. Hersom, 4825 N. Banana River Blvd., Cocoa Beach, FL (US) 32931

( * ) Notice: Subject to any disclaimer, the term of this patent is extended or adjusted under 35 U.S.C. 154(b) by 0 days.

(21) Appl. No.: 09/667,291

(22) Filed: Sep. 22, 2000

(51) Int. Cl.[7] ..... B63H 20/36
(52) U.S. Cl. ..... 440/2; 116/28 R; 440/113
(58) Field of Search ..... 116/28 R; 248/481, 248/475.1, 482; 440/2, 113

(56) References Cited

U.S. PATENT DOCUMENTS

| | | | | |
|---|---|---|---|---|
| 1,934,223 A | * | 11/1933 | Booth | |
| 2,078,179 A | | 4/1937 | Johnsn et al. | 115/5 |
| 2,719,503 A | | 10/1955 | Smith | 115/18 |
| 2,963,000 A | | 12/1960 | Fester | 115/42 |
| 3,136,280 A | | 6/1964 | Bergum | 115/17 |
| 3,209,716 A | | 10/1965 | Hartley | 114/145 |
| 3,633,531 A | | 1/1972 | Hayes | 114/145 A |
| 3,885,146 A | | 5/1975 | Whitley, Jr. | 240/7.1 R |
| 3,905,680 A | * | 9/1975 | Nagel | |
| 4,286,309 A | | 8/1981 | Rasinski | 362/61 |
| 4,993,978 A | | 2/1991 | Johanes | 440/71 |
| 5,035,441 A | * | 7/1991 | Murray | |
| 5,088,439 A | * | 2/1992 | Anderson | |
| 5,273,399 A | | 12/1993 | Ojeda | 416/146 R |
| D380,402 S | | 7/1997 | Binder, Sr. | D10/111 |

* cited by examiner

*Primary Examiner*—Sherman Basinger
(74) *Attorney, Agent, or Firm*—Brian S. Steinberger; Law Offices of Brian S. Steinberger, P. A.

(57) ABSTRACT

An outboard motor reflector for use on boats being towed. The reflector can be attached to a longitudinal arm that is attached to the boat motor either above or below the propeller hub. The reflector can pivot and be oriented to multiple directions so that the reflector remains visible to drivers behind the towed boat regardless of whether the outboard motor is in a down position or is any raised position. Clamp prongs extend about sides of the motor housing and adjustable straps further lock the reflector to the outboard motor.

14 Claims, 7 Drawing Sheets

OUTBOARD REFLECTOR KIT

This invention relates to reflectors, and in particular to boats, and in particular to reflectors that can be attached to outboard motors on boats being transported by trailers.

BACKGROUND AND PRIOR ART

Trailer mounted outboard engine motor boats are becoming more popular in recent years and have come with problems. For example, the outboard motor generally extends rearward beyond the edge of the trailer that is carrying it. Traditional trailer mounted rear tail lights do not warn drivers trailing behind the trailer that something is extending beyond the trailer's tail lights. Thus, the high and rearward extended position of the outboard motors on the rear of the boat has resulted in collisions with vehicles traveling behind the towed boats.

The chances for collision further increase if the trailer's tail lights are not working, or are missing, or are just not easily visible to those behind the trailers.

Additionally, rear facing trailer taillights do not prevent the problem of avoiding side collisions with the trailer.

Various proposals have been made over the years to correct the problem. Red flags and reflectors have been attempted to be used. However, there are no good mounts for supporting either flagpoles or reflectors on the outboard engine motors.

U.S. Pat. No. 4,993,978 to Johannes describes a "boat motor reflector" device that attaches to an outboard motor. However, the Johannes patent is limited to one reflector facing rearwardly and does not have any side facing reflectors. Thus, side collisions are not avoided here. Additionally, this device only uses a mounting fork that can loosen and fall of the mounting motor. Still furthermore, Johannes' one rear facing reflector is fixed in one bent position which limits that visibility of having the reflector portions always being fully facing rearwardly. Thus, raising the motor to different raised positions results in the reflector portion not always being fully rearwardly facing.

Other patents that also fail to overcome the problems described above include: U.S. Pat. No. 2,078,179 to Johnson et al.; U.S. Pat. No. 2,719,503 to Smith; 2,963,000 to Fester; U.S. Pat. No. 3,136,280 to Bergum; U.S. Pat. No. 3,209,716 to Hartley; U.S. Pat. No. 3,633,531 to Hayes; U.S. Pat. 3,885,146 to Whitley, Jr.; U.S. Pat. No. 4,286,309 to Rasinski; U.S. Pat. No. 5,273,399 to Ojeda; and U.S. Pat. No. Des. 380,402 to Binder, Sr.

SUMMARY OF THE INVENTION

The first objective of the invention is to provide a reflector for outdrive boat motors that can pivot in multiple directions while the motor is pivoted in multiple directions.

The second objective of the invention is to provide a reflector for outdrive boat motors having reflectors that face rearwardly and on both sides of the motor.

The third objective of the invention is to provide a reflector for an outdrive boat motor that is easy to attach and detach to the outboard boat motor.

A preferred embodiment of the outboard-reflector assembly includes a rear facing reflector; and means for pivotally mounting the rear facing reflector to an outboard motor, wherein the reflector can pivot relative to the outboard motor so that the reflector is continuously visible to drivers behind the towed boat whether or not the outboard motor is in a down position or is raised to any upward position. The means for pivotally mounting the reflector can include a longitudinal horizontal mounting member for attaching the reflector to the motor and a hinge such as a gimbal type ball for allowing the reflector to pivot relative to the mounting member.

The mounting member is attached to the motor by an adjustable strap that can be tightened such as hook and loop fasteners, a belt buckle, a bungee cord, and the like, and clamps The clamp can have prongs which abut to both sides of the motor drive shaft housing above the propeller or to both sides of the skeg fin beneath the propeller. The strap can attach to the propeller hub housing or about the drive shaft housing. The invention can further include additional side reflectors to further increase the visibility of the outboard motor.

Further objects and advantages of this invention will be apparent from the following detailed description of a presently preferred embodiment which is illustrated schematically.in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
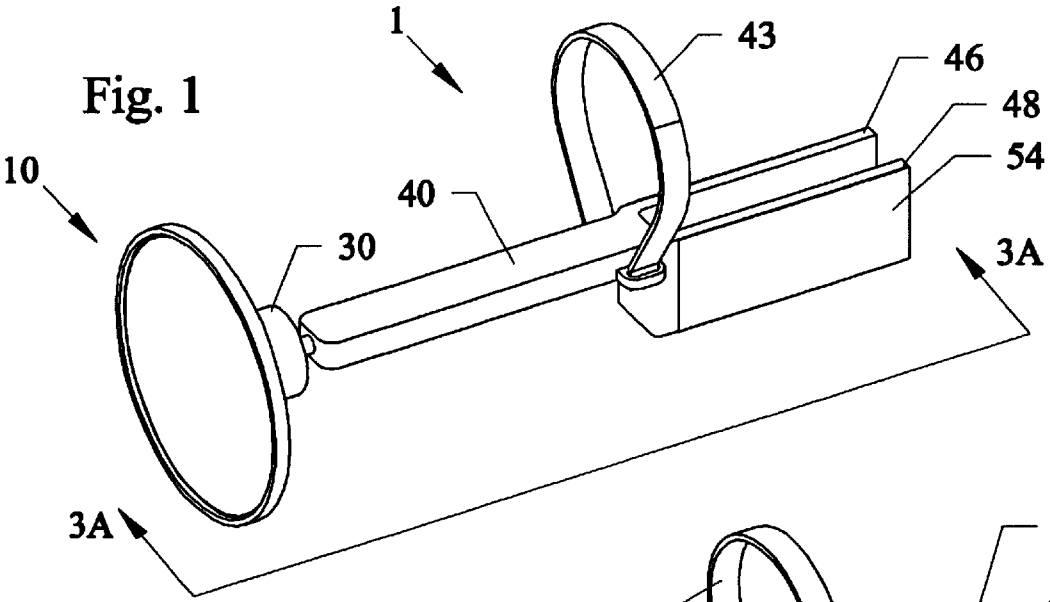
FIG. 1 is a perspective view of the outboard reflector.
Figure 2:
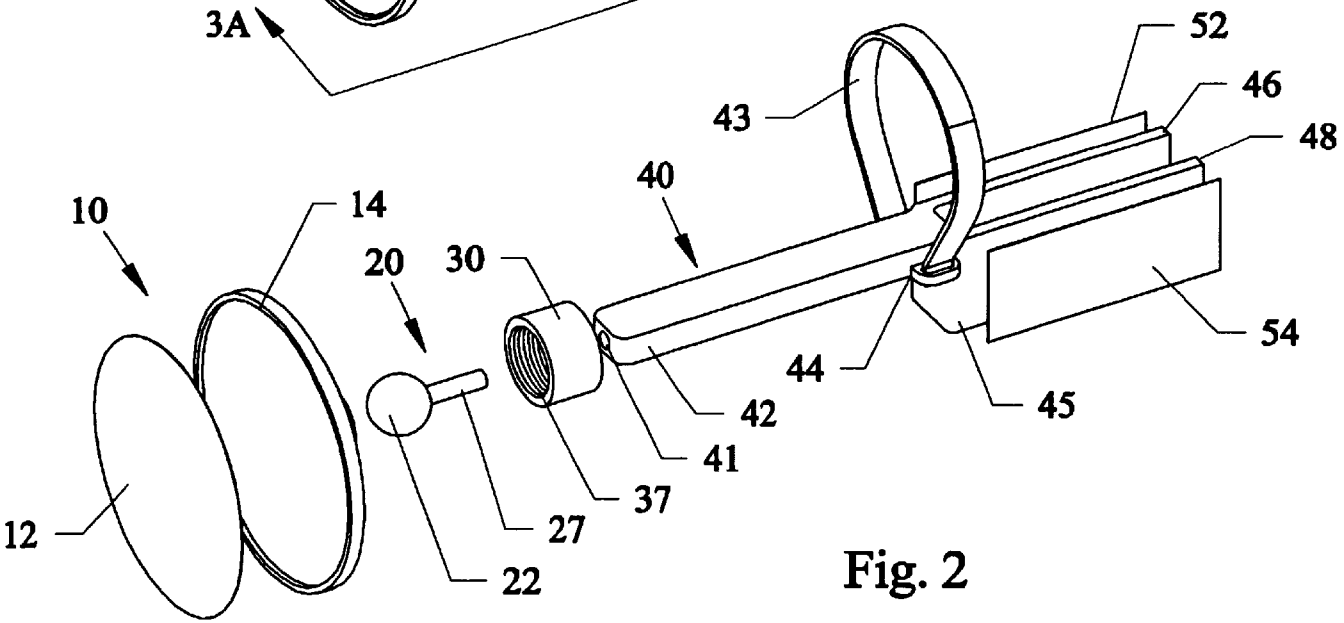
FIG. 2 is an exploded view of the outboard reflector of FIG. 1.
Figure 3A:
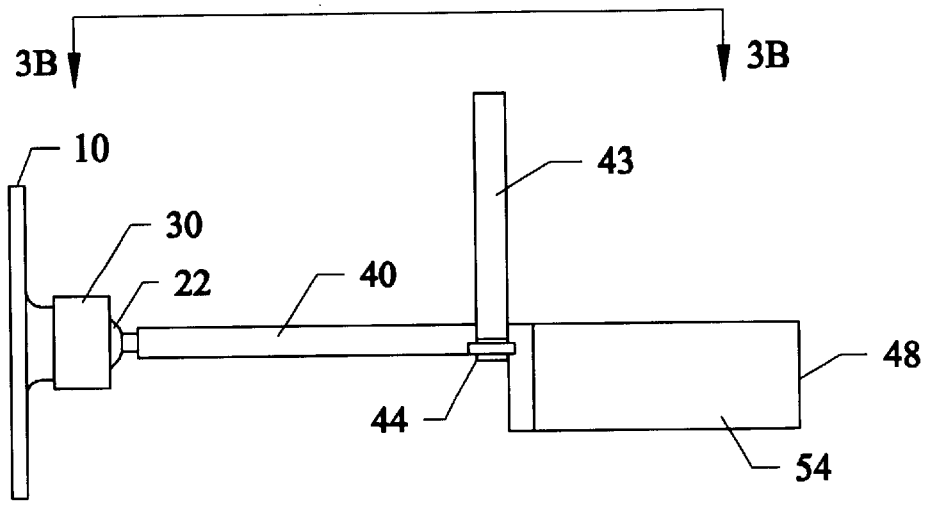
FIG. 3A is a side view of the outboard reflector of FIG. 1 along line arrows 3A—3A.
Figure 3B:
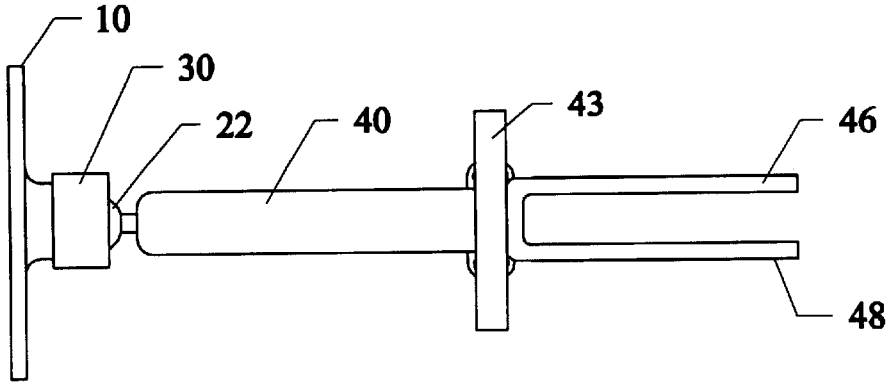
FIG. 3B is a top view of the outboard reflector of FIG. 3A along line arrows 3B—3B.
Figure 4:
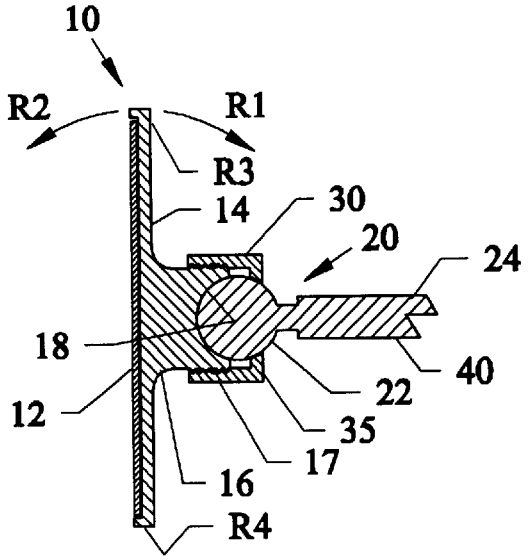
FIG. 4 is a cross-sectional view of the reflector and internal pivoting gimbal of FIGS. 3A–3B.

FIG. 1 is a perspective view of the outboard reflector assembly 1. FIG. 2 is an exploded view of the outboard reflector assembly 1 of FIG. 1. FIG. 3A is a side view of the outboard reflector assembly 1 of FIG. 1 along line arrows 3A—3A. FIG. 3B is a top view of the outboard reflector assembly of FIG. 3A along line arrows 3B—3B. FIG. 4 is a cross-sectional view of the reflector 10 and internal pivoting gimbal 20 of FIGS. 3A–3B. Referring to FIGS. 1–4, assembly 1 includes reflector 10 having a main reflecting surface portion 12 which can be a circular disc shape, rectangular, triangular and the like, attached to a T-shaped support member 14 having an extended bottom protruding portion 16 with concave bottom edge 18. A gimball member 20 having a ball 22 at one end and an extended tail member 24, where the ball 22 abuts against the concave edge 18 of support member 14 and is held in place by a cap 30 having threaded portions 37 mateably thread with external threads 17 of protruding portion 16 of support member 14. The cap 30 has an opening 35 for allowing the tail member 24 to extend therethrough. A longitudinal mounting member 40 has one end 42 with an internally threaded side hole 41 for receiving the threaded end 27 of tail member 24 therethrough. Attached about a mid-section 44 of mounting member 40 is a vertically raised strap 43 that can be a hook and loop fasteners(such as Velcro®), a belt strap with buckle, a single bungee type cord, and the like. The rear end 45 of mounting member 40 includes a clamp section 45 having dual fork shaped prongs 46, 48 extending outwardly therefrom. On the exterior sides of the clamp prongs 46, 48 can be additional side reflectors 52, 54 that can be adhered thereon. Referring to FIG. 4, reflector 10 and cap 30 can pivot in plural arc directions of R1, R2, R3, R4, and the like, relative to horizontally longitudinal mounting member 40 by concave edge 18 sliding against ball 22. The cap 30 can be rotated to be tightened so that the reflector is oriented in to a selected position.

Figure 5A:
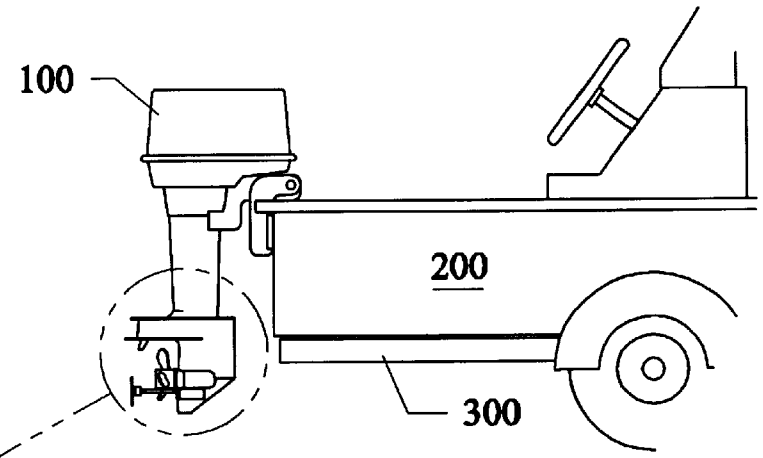
FIG. 5A is a side view of a boat on a trailer with the reflector of the proceeding figures mounted on an outboard motor being in a down position.
Figure 5B:
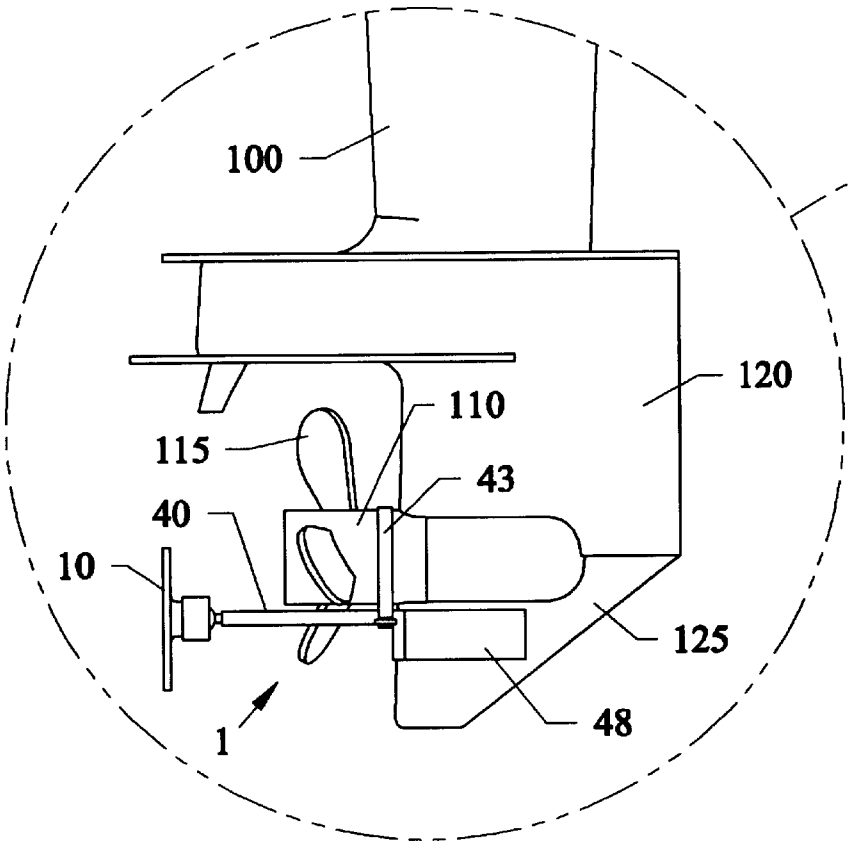
FIG. 5B is an enlarged view of the reflector and outboard motor of FIG. 5A.
Figure 6A:
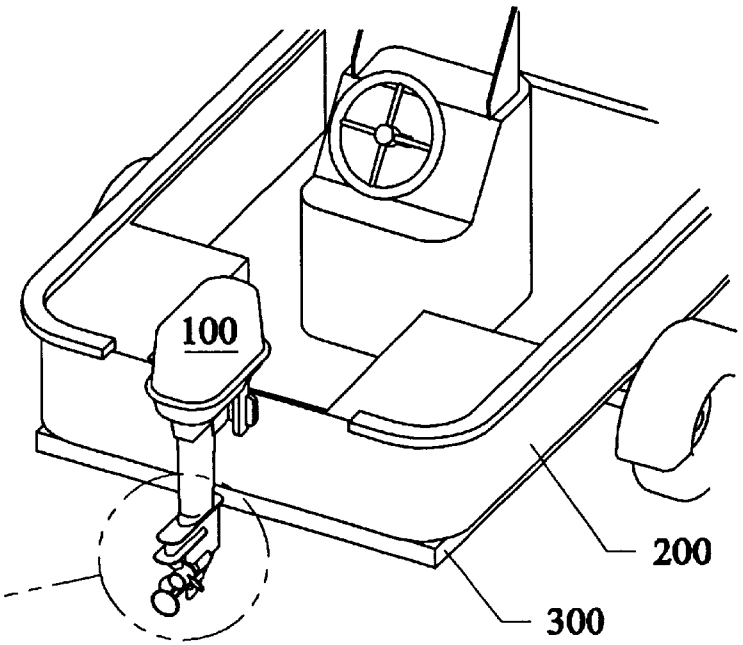
FIG. 6A is a perspective view of the boat on trailer and motor mounted reflector of FIG. 5A.
Figure 6B:
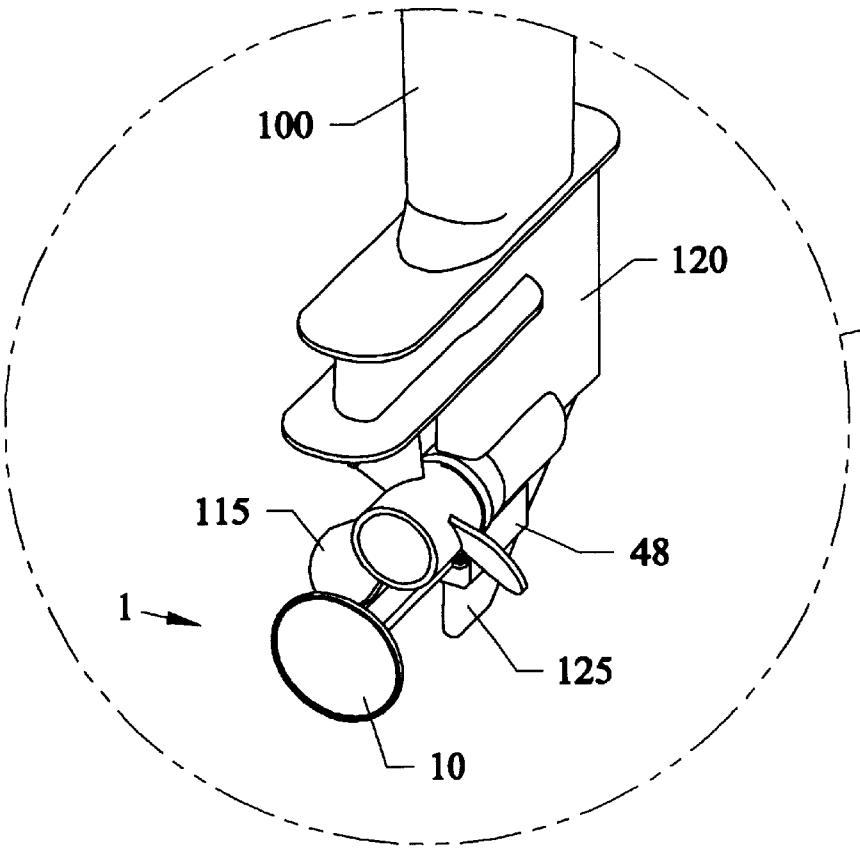
FIG. 6B is an enlarged view of the reflector and outboard motor of FIG. 6A.

FIG. 5A is a side view of a boat 200 on a trailer 300 with the reflector assembly 1 of the preceding figures mounted on an outboard motor 100 being in a down position. FIG. 5B is an enlarged view of the reflector assembly 1 and outboard motor 100 of FIG. 5A. FIG. 6A is a perspective view of the boat 200 on trailer 300 and motor mounted reflector assembly 1 of FIG. 5A. FIG. 6B is an enlarged view of the reflector assembly 1 and outboard motor 100 of FIG. 6A. Referring to FIGS. 5A–6B, strap 43 is positioned to tightly wrap about the outer hub shaft 110 behind the propeller blades 115 of the outboard motor 100. Simultaneously, clamp prongs 46, 48(only one is shown) are positioned by the installer to wrap about the sides of the skeg fin 125 which extends downward from the propeller drive train housing 120. With the outboard motor 100 in a downward position, the rear facing reflector 10 is oriented to be perpendicular to the longitudinal mounting member 40.

Figure 7A:
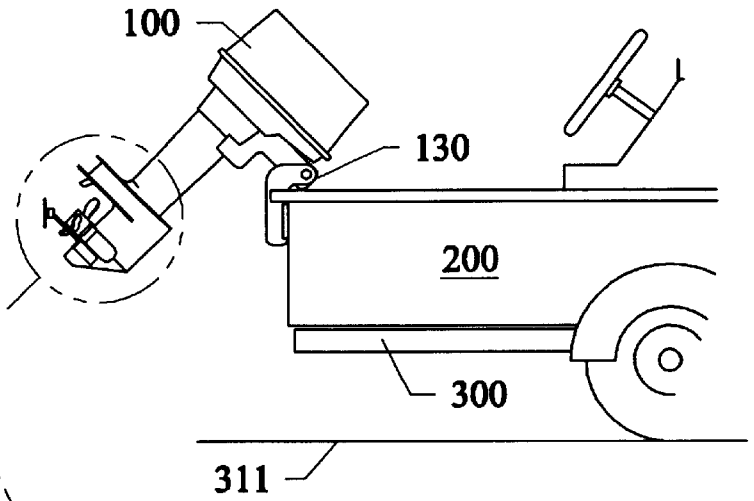
FIG. 7A is a side view of the boat on trailer and reflector mounted on the outboard motor of FIG. 5A with the outboard motor in a raised position.
Figure 7B:
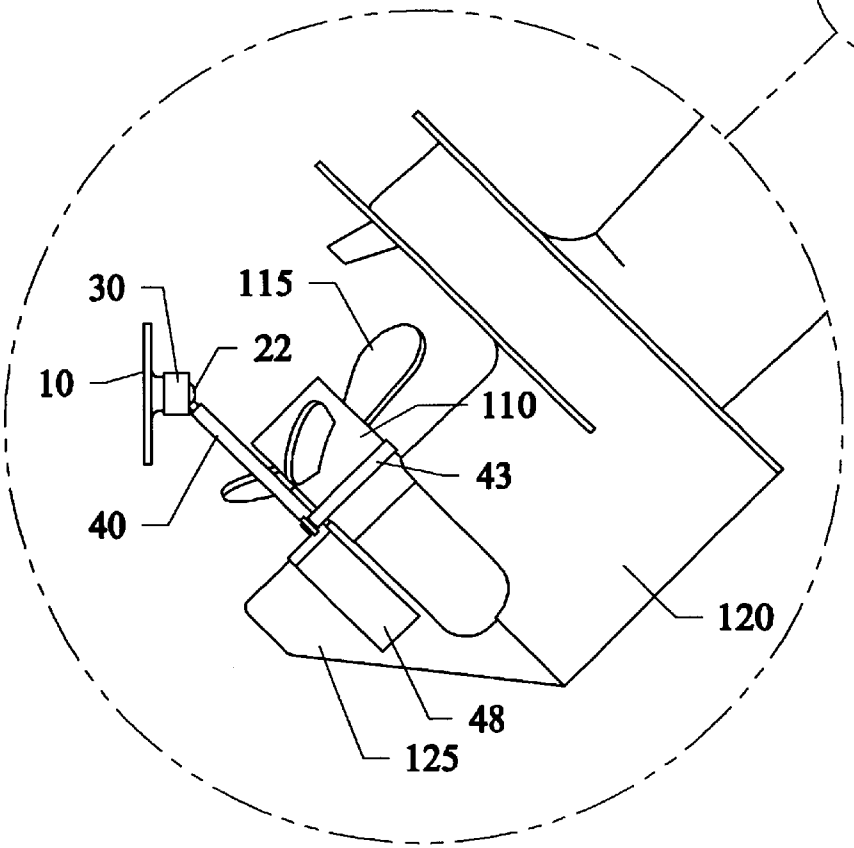
FIG. 7B is an enlarged view of the reflector and outboard motor of FIG. 7A.
Figure 8A:
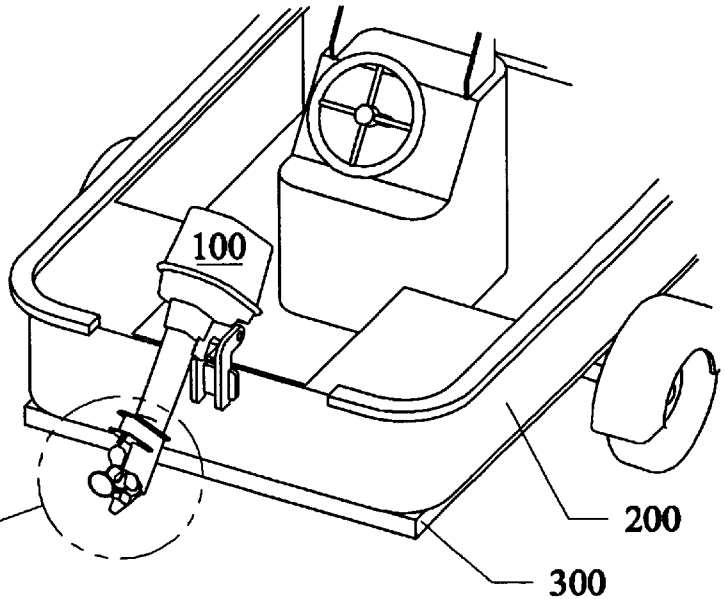
FIG. 8A is a perspective view of the boat on trailer and motor mounted reflector of FIG. 7A.
Figure 8B:
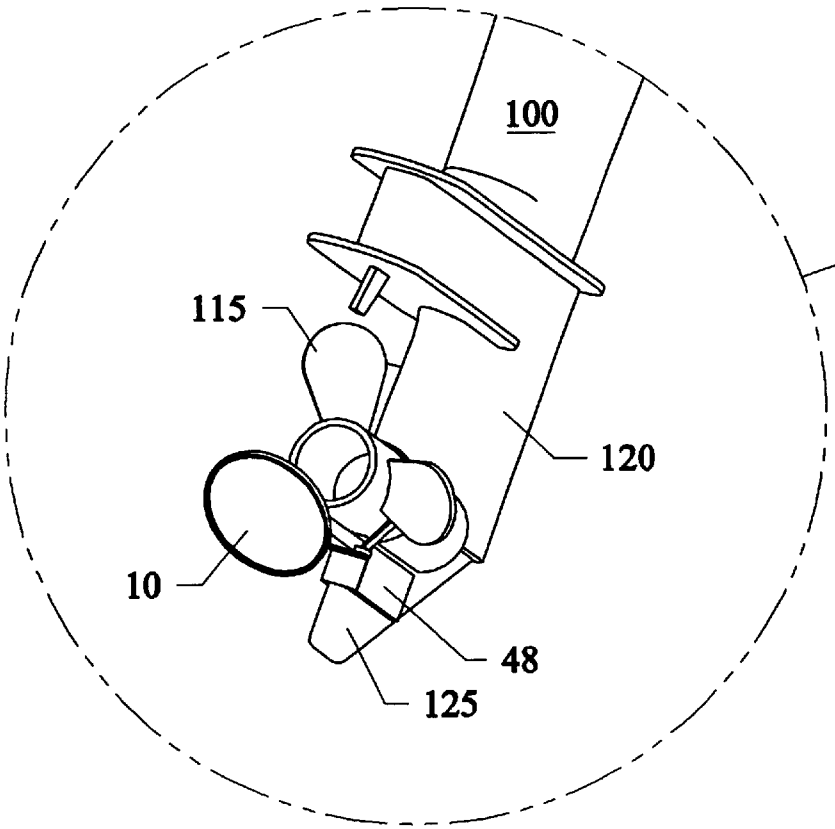
FIG. 8B is an enlarged view of the reflector and outboard motor of FIG. 8A.

FIG. 7A is a side view of the boat 200 on trailer 300 and reflector assembly 1 mounted on the outboard motor 100 of FIG. 5A with the outboard motor 100 in a raised position. FIG. 7B is an enlarged view of the reflector assembly 1 and outboard motor 100 of FIG. 7A. FIG. 8A is a perspective view of the boat 200 on trailer 300 and motor mounted reflector assembly 1 of FIG. 7A. FIG. 8B is an enlarged view of the reflector assembly 1 and outboard motor 100 of FIG. 8A. Referring to FIGS. 7A–8B, the outboard motor 100 is tilted at hinge point 130 so that propeller end 115 is raised upward during transportation. The reflector 10 can be pivoted relative to mounting member 40 to continue to be perpendicular to ground level 310 while the rear facing reflector is no longer perpendicular to mounting member 40.

Figure 10A:
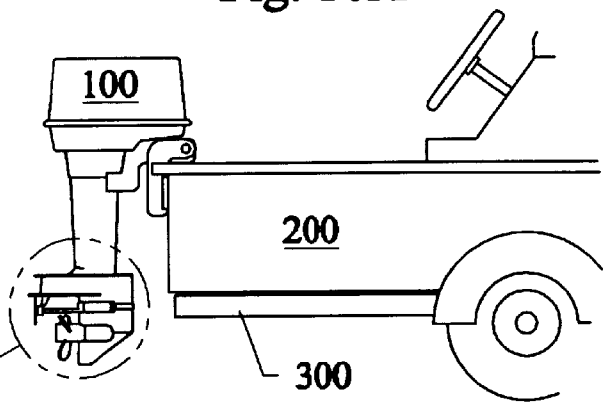
FIG. 10A is a side view of the reflector of FIG. 9 mounted to a motor on a boat and trailer.
Figure 10B:
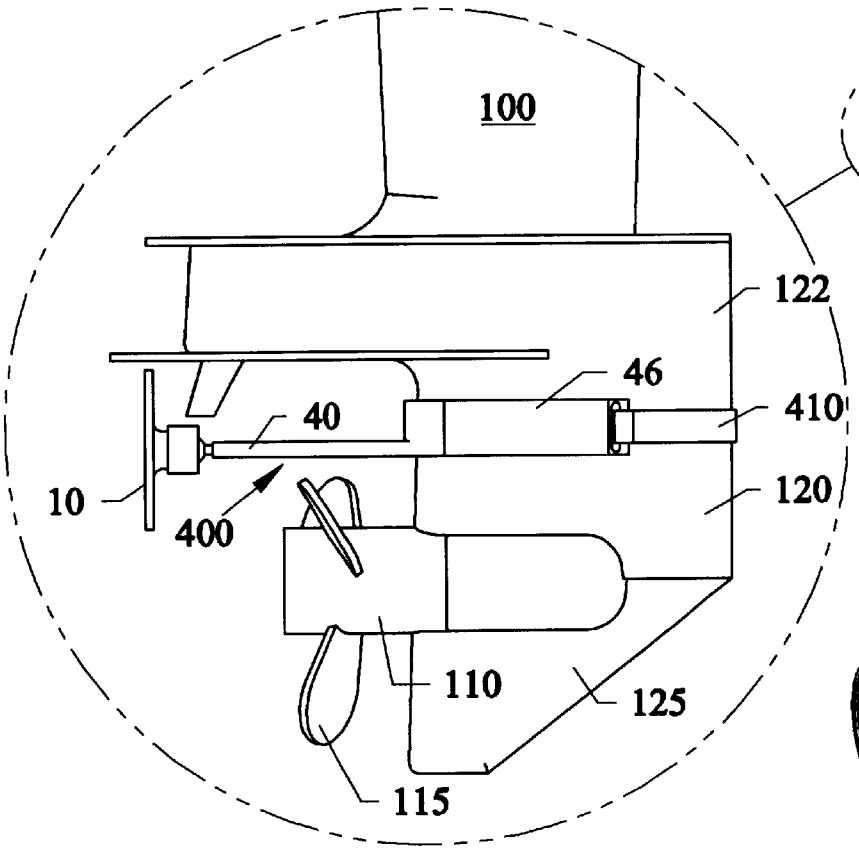
FIG. 10B is an enlarged view of the reflector and outboard motor of FIG. 10A.
Figure 9:
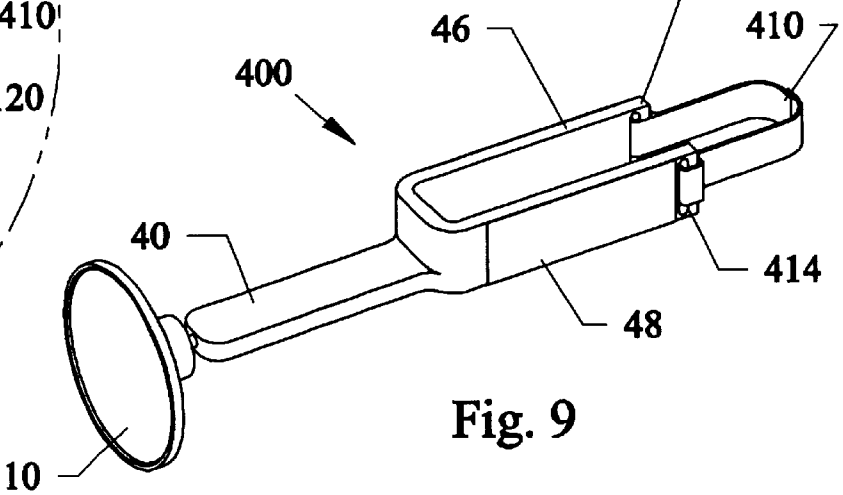
FIG. 9 is a perspective view of another version of the outboard motor reflector.

FIG. 9 is a perspective view of another version of the outboard motor reflector assembly 400. FIG. 10A is a side view of the reflector assembly 400 of FIG. 9 mounted to an outboard motor 100 on a boat 200 and trailer 300. FIG. 10B is an enlarged view of the reflector assembly 400 and outboard motor 100 of FIG. 10A. Referring to FIGS. 9–10B, reflector assembly 400 is similar to reflector assembly 1 previously described with the exception that the attachment strap 410 is horizontal and extends rearwardly from the assembly so that strap 410 has ends 412, 414 attached to outer ends of clamp prongs 46, 48, respectively. For installation, the reflector assembly 400 has clamp prongs 46, 48 attached about the sides of propeller drive train housing 120 above the propeller 115 and propeller hub 110, with the strap tightened about a front edge 122 of housing 120. The reflector 10 pivots relative to the mounting member 40 similar to the previous version.

The reflector assembly can be manufactured and sold in a kit form that allows anyone to be able to install the reflector onto an outboard motor.

The components of the reflector assembly can be made from injection molded plastic, aluminum, combinations thereof, and the like. For example, the prongs of the clamp can be rigid prongs.

While the reflectors have been described as having reflective surfaces, the invention can be used where an electrical type light source can be used with and/or instead of the rear facing and side facing reflectors, where the light source can be powered off a car/boat battery, and/or the light source can have a rechargeable battery power supply.

Although the reflector surface 12 is shown being flat and planar, the reflector can have various shapes such as but not limited to rectangular, triangular, polygon, and the like, so that a single reflector can be seen from the rear and both sides of the outboard motor 100.

Although the reflector 10 is shown being rotated to only two positions, the gimbal ball allows the reflector the versatility to rotate in various planes so that the reflector would be visible to drivers behind the towed boat whether or not the motor is raised upward or the motor is turned and angled to different side positions, and the like.

The reflector can be used as advertisements for boats, engines, accessories, and the like. For example, a business name can be engraved into the reflector, and/or decals can be attached to the reflector, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An outboard-reflector assembly for mounting to an outboard boat motor, comprising in combination:

an outboard boat motor having a front side, a left side, a right side and a rear side, and a hub shaft extending from the rear side with a propeller thereon;

a first reflector;

a clamp having one end attached to the first reflector, and a second end having dual parallel rigid prongs, wherein a portion of the second end of the clamp abuts against a portion of the rear side of the motor, and each of the prongs wraps about side portions of the motor; and a strap for attaching the clamp to the outboard motor.

2. The assembly of claim 1, wherein the portion of the rear side of the motor includes:

a skeg fin beneath the propeller, wherein the prongs of the clamp wrap about the skeg fin beneath the propeller.

3. The assembly of claim 2, wherein the strap includes:

a vertical strap for attaching the clamp about a portion of the hub shaft of motor.

4. The assembly of claim 1, wherein the strap includes:

a vertical strap for attaching the clamp to the hub shaft of the motor.

5. The assembly of claim 1, further comprising:

a second reflector oriented substantially perpendicular to the first reflector, the second reflector being mounted on at least one exterior facing surface of one of the prongs.

6. The assembly of claim 5, further comprising:

a third reflector oriented substantially perpendicular to the first reflector, the third reflector mounted on an exterior surface of another one of the prongs.

7. An outboard-reflector assembly for mounting to an outboard boat motor, comprising in combination:

an outboard boat motor having a front side, a left side, a right side and a rear side, and a hub shaft extending from the rear side with a propeller thereon, and a skeg fin beneath the hub shaft;

a first reflector;

a clamp having one end attached to the first reflector, and a second end wrapped about a portion of the skeg fin, the clamp having a rear end portion and dual parallel rigid prongs extending from the rear end portion, wherein the rear end portion abuts against a portion of the skeg fin and each of the prongs wraps about side portions of the skeg fin; and a strap for attaching the clamp to the outboard motor.

8. The assembly of claim 7, wherein the strap includes:

a vertical strap for attaching the assembly about a portion of the hub shaft of the motor.

9. The assembly of claim 7, further comprising:

a second reflector oriented substantially perpendicular to the first reflector, the second reflector being mounted on at least one exterior facing surface of one of the prongs.

10. The assembly of claim 9, further comprising:

a third reflector oriented substantially perpendicular to the first reflector, the third reflector mounted on an exterior surface of another one of the prongs.

11. An outboard-reflector assembly for mounting to an outboard boat motor, comprising in combination:

an outboard boat motor having a front side, a left side, a right side and a rear side, and a horizontal hub shaft extending from the rear side with a propeller thereon;

a first reflector;

a clamp having one end attached to the first reflector, and a second end attached to the motor, the clamp having a rear end with dual parallel rigid prongs, wherein a portion of the second end of the clamp abuts against a portion of the rear side of the motor, and each of the prongs wraps about side portions of the motor; and a strap for attaching the assembly about a portion of the horizontal hub staff of the motor.

12. The assembly of claim 11, wherein the strap includes:

a vertical strap.

13. The assembly of claim 11, further comprising:

a second reflector oriented substantially perpendicular to the first reflector, the second reflector being mounted on at least one exterior facing surface of one of the prongs.

14. The assembly of claim 13, further comprising:

a third reflector oriented substantially perpendicular to the first reflector, the third reflector mounted on an exterior surface of another one of the prongs.

* * * * *